US009859608B2

(12) United States Patent
Wang et al.

(10) Patent No.: US 9,859,608 B2
(45) Date of Patent: Jan. 2, 2018

(54) ANTENNA MODULE

(71) Applicants: Chao Wang, Shenzhen (CN); Jianchun Mai, Shenzhen (CN)

(72) Inventors: Chao Wang, Shenzhen (CN); Jianchun Mai, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 164 days.

(21) Appl. No.: 15/008,641

(22) Filed: Jan. 28, 2016

(65) Prior Publication Data

US 2017/0012354 A1 Jan. 12, 2017

(30) Foreign Application Priority Data

Jul. 8, 2015 (CN) ..... 2015 2 0490777 U

(51) Int. Cl.

| | |
|---|---|
| ***H01Q 1/38*** | (2006.01) |
| ***H01Q 1/24*** | (2006.01) |
| ***H01Q 9/04*** | (2006.01) |
| ***H01Q 5/371*** | (2015.01) |

(52) U.S. Cl.

CPC ..... *H01Q 1/243* (2013.01); *H01Q 5/371* (2015.01); *H01Q 9/0421* (2013.01)

(58) Field of Classification Search

CPC ..... H01Q 1/24; H01Q 1/38; H01Q 9/0421; H01Q 5/371

USPC ..... 343/700 MS

See application file for complete search history.

(56) References Cited

U.S. PATENT DOCUMENTS

| | | | | |
|---|---|---|---|---|
| 9,026,187 | B2 * | 5/2015 | Huang | H05K 5/0086 455/41.1 |
| 2011/0001673 | A1 * | 1/2011 | You | H01Q 1/243 343/702 |
| 2012/0105287 | A1 * | 5/2012 | Jung | H01Q 1/243 343/702 |
| 2012/0176278 | A1 * | 7/2012 | Merz | H01Q 1/243 343/702 |
| 2013/0135158 | A1 * | 5/2013 | Faraone | H01Q 13/10 343/702 |
| 2014/0078008 | A1 * | 3/2014 | Kang | H01Q 5/35 343/702 |

* cited by examiner

*Primary Examiner* — Huedung Mancuso
(74) *Attorney, Agent, or Firm* — Na Xu; IPro, PLLC

(57) ABSTRACT

An antenna module applicable to a mobile device is provided in the present disclosure. The antenna module includes a metal frame, a circuit board surrounded by the metal frame, and an antenna portion on the circuit board. The circuit board includes a main board and a ground board placed on the main board. The antenna portion includes at least one low frequency (LF) ground point and at least one high frequency (HF) ground point arranged on the ground board, and a feed point arranged on the main board. The at least one LF ground point and the at least one HF ground point contact the metal frame; a first current path length between the feed point and the at least one LF ground point is greater than a second current path length between the feed point and the at least one HF ground point.

10 Claims, 2 Drawing Sheets

ANTENNA MODULE

FIELD OF THE DISCLOSURE

The present disclosure generally relates to mobile communication technologies, and more particularly, to an antenna module applicable to a mobile device.

BACKGROUND

With development of mobile communication technologies, mobile devices such as mobile phones, personal digital assistant, tablet computers, or the like, are used more and more widely. Mobile devices normally use antenna modules to convert electric power into radio waves, and vice versa, so as to enable the mobile devices to perform wireless transmission and reception.

Mobile devices with metal frames are preferred by people because of their fashion appearance as well as good durability. However, a metal frame may bring an electromagnetic interference to the antenna module of the mobile device, and therefore, in a typical mobile device, one or more break points are formed at the metal frame in order to reduce the electromagnetic interference. Nevertheless, the break points may impact the appearance as well as integrity of the metal frame. In addition, the antenna module also needs to include necessary matching elements at a ground portion thereof for performing ground matching; the matching elements may deteriorate antenna efficiency and an available bandwidth range (especially a high frequency bandwidth range) of the antenna module.

Therefore, it is desired to provide a new antenna module which can overcome the aforesaid problems.

BRIEF DESCRIPTION OF THE DRAWINGS

Many aspects of the embodiment can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and the embodiment thereof.

Figure 1:
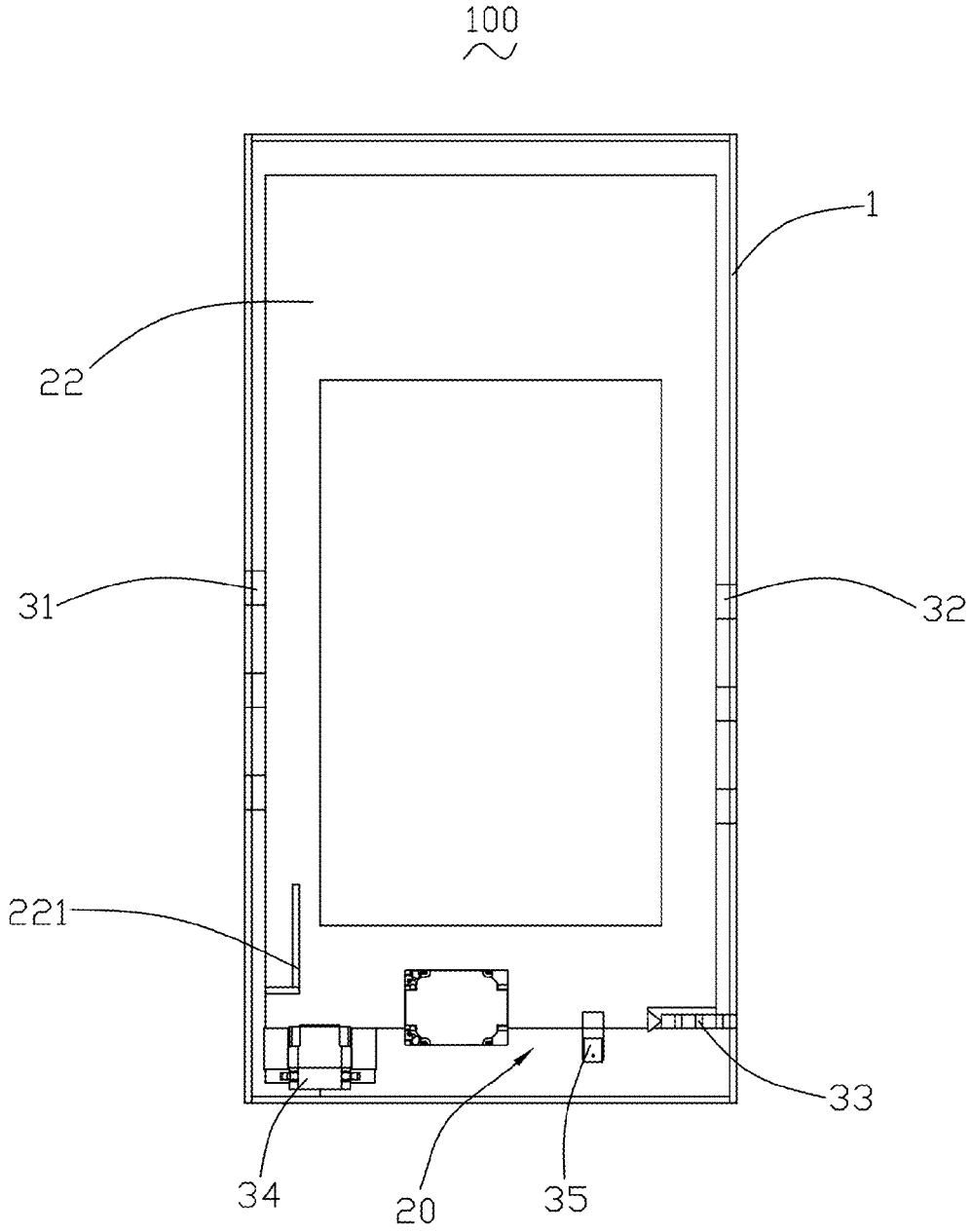
FIG. 1 is a schematic planar view of an antenna module according to an embodiment of the present disclosure.
Figure 2:
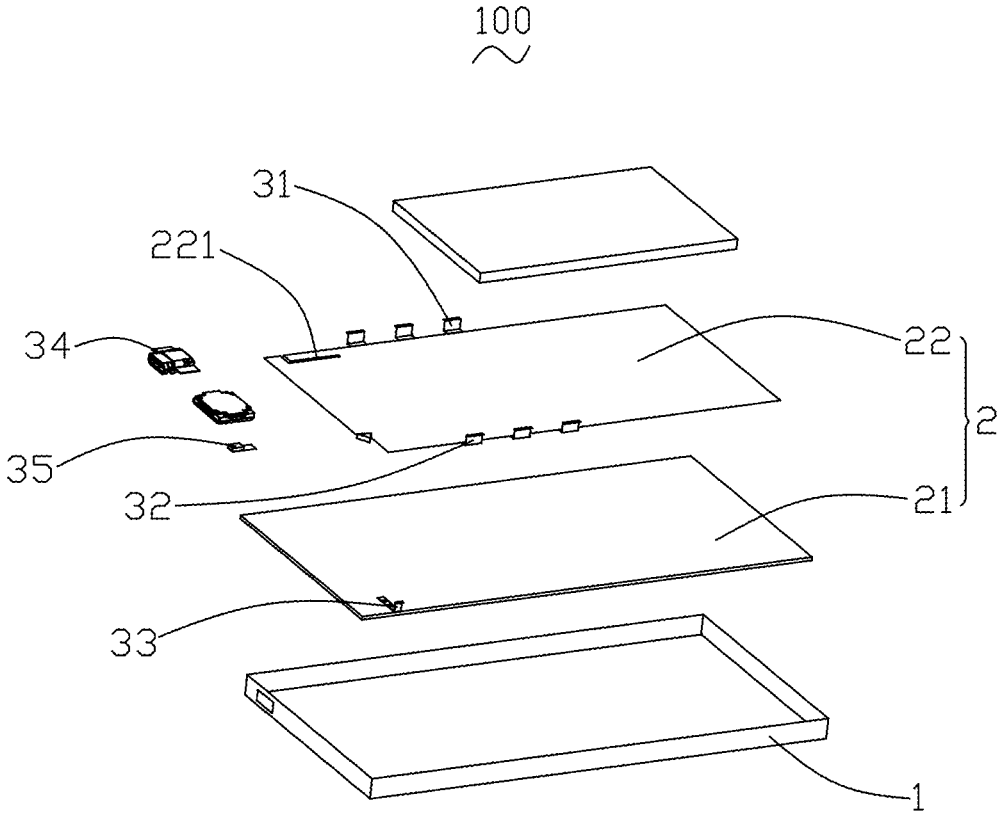
FIG. 2 is an exploded view of the antenna module of FIG. 1.

Referring to FIGS. 1-2, an antenna module 100 according to an embodiment of the present disclosure is shown. The antenna module 100 is applicable to a mobile device such as a mobile phone, a personal digital assistant, a tablet computer, or the like. The antenna module 100 includes a metal frame 1 and a circuit board 2 received in the metal frame 1; and moreover, an antenna portion of the antenna module 100 is provided on the circuit board 2.

The metal frame 1 may serve as a main frame or shell of the mobile device in which the antenna module 100 is applied, and has a rectangular one-piece frame configuration. For example, the metal frame 1 may include four sidewalls; namely, a pair of long sidewalls and a pair of short sidewalls. The pair of long sidewalls is opposite to and parallel to each other, and the pair of short sidewalls are parallel to each other and perpendicular to the long sidewalls. The pair of long sides and the pair of short sidewalls are connected end to end and cooperatively form a receiving space for receiving the circuit board. The metal frame 1 surrounds the circuit board 2 for forming gaps between the sidewalls of the metal frame 1 and the circuit board 2. Moreover, in the present embodiment, a clearance area 20 is defined at a region between one of the short sidewalls of the metal frame 1 and the circuit board 2.

The circuit board 2 includes a main board 21 and a ground board 22. The main board 21 may be a rectangular or elongated board, and includes matching circuit disposed thereon. The ground board 22 may also be a rectangular or elongated board with a size smaller than the main board 21, and is placed on a top surface of the main board 21.

The antenna portion of the antenna module 100 includes a feed point 33 arranged on the main board 21, and also includes a plurality of low frequency (LF) ground points 31 and a plurality of high frequency (HF) ground points 21, both of which are arranged on the ground board 22. The LF ground points 31 and the HF ground points 32 are distributed at two opposite edges of the ground board 22 respectively, and are symmetrical to each other about a central axis of the ground board parallel to the long sidewalls. The LF ground points 31 may contact and abut against a middle portion of long sidewalls of the metal frame 1, and similarly, the HF ground points 32 may contact and abut against a middle portion of another long sidewall of the metal frame 1. In other words, the LF ground points 31 and the HF ground points 32 are both grounded directly, without any ground component which is liable to introduce undesired loss, and therefore, an available bandwidth as well as an antenna efficiency of the antenna module 100 can be improved.

In the present disclosure, a current path length between the feed point 33 and the LF ground points 31 is defined as a first current path length, and a current path length between the feed point 33 and the HF ground points 32 are defined as a second current path length. The first current path length is greater than the second current path. For example, in one embodiment, the first current path length may be substantially equal to a half of an LF resonance wavelength of the antenna module 100, and the second current path length may be substantially equal to a half of an HF resonance wavelength of the antenna module 100. Since an LF physical length and an HF physical length of the antenna module 100 respectively correspond to a distance between the feed point 33 and the LF ground points 31 and a distance between the feed point 33 and the HF ground points 32, in practice, LF resonance and HF resonance can be obtained by adjusting the distance between the feed point 33 and the LF ground points 31 and the distance between the feed point 33 and the HF ground points 32.

The ground board 22 may further include a semi-close groove 221. The semi-close groove 221 is formed at a same side as the LF ground points 31, and is configured for extending the first current path length between the feed point 33 and the LF ground points 31, so as to obtain additional HF resonance. The semi-close groove 221 may have an L-shaped configuration, and an end of the semi-close groove 221 is opened at a corresponding edge of the ground board 22.

In the present embodiment, the feed point 33 is arranged at an edge of the main board 21, and is located in the clearance area 20. Normally, no electrical component is provided in the clearance area 20 to ensure a performance of the antenna module 100; however, in practice, the clearance area 20 may include some components having little impact on the antenna efficiency of the antenna module 100.

Furthermore, the ground board 22 may further include a first protrusion part 34 and a second protrusion part 35, both of which protrude to the clearance area 20 from a corresponding edge of the ground board 22. The second protrusion part 35 is closer to the feed point 33 than the first protrusion part 34.

For example, a distance between the feed point 33 and the first protrusion part 34 may be substantially equal to a quarter of the LF resonance wavelength of the antenna module 100, which corresponds to a current zero-point of the LF resonance. A distance between the feed point 33 and the second protrusion part 35 may be substantially equal to a quarter of a secondary LF resonance wavelength of the antenna module 100, which corresponds to a current zero-point of the secondary LF resonance. Accordingly, adjustment in size and location of the first protrusion part 34 and the second protrusion part 35 can change a current distribution of the circuit board 2, which can be used for adjusting an LF resonance frequency as well as a secondary LF resonance frequency of the antenna module 100, so that the antenna module 100 can operate in communication frequency bands as required.

In summary, in the antenna module 100 as provided in the present disclosure, no break point needs to be formed at the metal frame 1 of the antenna module 100, this can ensure the metal frame 1 to maintain good appearance and integrity. Moreover, the ground board 22 of the antenna module 100 is grounded directly by using the LF ground points 31 and the HF ground points 32 to contact the metal frame 1, no ground component which is liable to introduce undesired loss is needed, and therefore, the available bandwidth as well as an antenna efficiency of the antenna module 100 can be improved. Furthermore, the semi-close groove 221 formed at the ground part 22, and the first protrusion part 34 and the second protrusion part 35 extending from the ground board 22 to the clearance area 20 can provide additional HF resonance and improve high frequency coupling of the antenna module 100, and accordingly, the antenna module 100 can operate in a full frequency range from 824 MHz to 960 MHz and from 1710 MHz to 2690 MHz.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An antenna module, comprising:

a metal frame in shaped of a rectangular frame having two long sidewalls parallel to each other and two short sidewalls perpendicular to the two long sidewalls;

a circuit board surrounded by the metal frame, the circuit board comprising a main board and a ground board placed on the main board; and an antenna portion on the circuit board, the antenna portion comprising at least one low frequency (LF) ground point and at least one high frequency (HF) ground point arranged on the ground board, and a feed point arranged on the main board;

wherein the metal frame surrounds the circuit board for forming gaps between the sidewalls of the metal frame and the circuit board;

wherein the at least one LF ground point and the at least one HF ground point are arranged at two opposite edges of the ground board, and contacted the two long sidewalls of the metal frame respectively;

wherein the at least one LF ground point comprises a plurality of LF ground points, and the at least one HF ground point comprises a plurality of HF ground points; the LF ground points and the HF ground points are symmetrical to each other about a central axis of the ground board parallel to the long sidewalls of the metal frame;

wherein the at least one LF ground point and the at least one HF ground point contact the metal frame; a first current path length between the feed point and the at least one LF ground point is greater than a second current path length between the feed point and the at least one HF ground point.

2. The antenna module of claim 1, wherein the first current path length is substantially equal to a half of an LF resonance wavelength of the antenna module, and the second current path length is substantially equal to a half of an HF resonance wavelength of the antenna module.

3. The antenna module of claim 1, wherein a semi-close groove is formed at a same side of the ground board as the LF ground points.

4. The antenna module of claim 3, wherein the semi-close groove is configured for extending the first current path length between the feed point and the LF ground points, so as to obtain additional HF resonance.

5. The antenna module of claim 3, wherein the semi-close groove has an L-shaped configuration, an end of the semi-close groove is opened at a corresponding edge of the ground board.

6. The antenna module of claim 1, wherein a clearance area is formed in the antenna module at a region between one of the short sidewalls of the metal frame and the circuit board.

7. The antenna module of claim 6, wherein the feed point is arranged at an edge of the main board and is located in the clearance area.

8. The antenna module of claim 7, wherein the ground board further comprises a first protrusion part and a second protrusion part, both of which protrude to the clearance area from a corresponding edge of the ground board.

9. The antenna module of claim 8, wherein the second protrusion part is closer to the feed point than the first protrusion part.

10. The antenna module of claim 9, wherein a distance between the feed point and the first protrusion part is substantially equal to a quarter of the LF resonance wavelength of the antenna module, and a distance between the feed point and the second protrusion part is substantially equal to a quarter of a secondary LF resonance wavelength of the antenna module.

* * * * *